US005832830A

United States Patent [19]

Rancourt et al.

[11] Patent Number: 5,832,830

[45] Date of Patent: Nov. 10, 1998

[54] METHOD AND APPARATUS FOR NORMALIZING THE DISPLAY OF INK KEY ZERO POINTS IN AN INK FOUNTAIN

[75] Inventors: Michael Raymond Rancourt, Merrimack; Charles Douglas Lyman, Farmington, both of N.H.

[73] Assignees: Heidelberger Druckmaschinen AG, Heidelberg, Germany; Heidelberg Harris Inc., Dover, N.H.

[21] Appl. No.: 370,756

[22] Filed: Jan. 10, 1995

[51] Int. Cl.[6] ..... B41F 31/04

[52] U.S. Cl. ..... 101/365; 101/485

[58] Field of Search ..... 101/365, 350, 101/148, 363, 483, 484, 485

[56] References Cited

U.S. PATENT DOCUMENTS

| | | | |
|---|---|---|---|
| 4,008,664 | 2/1977 | Crum et al. . | |
| 4,639,776 | 1/1987 | Foerster et al. | 358/107 |
| 4,703,691 | 11/1987 | Takeuchi et al. | 101/365 |
| 4,854,234 | 8/1989 | Rancourt et al. . | |
| 4,903,596 | 2/1990 | Jeschke et al. | 101/148 |
| 5,029,527 | 7/1991 | Jeschke et al. | 101/365 |
| 5,138,944 | 8/1992 | Rancourt et al. | 101/365 |

FOREIGN PATENT DOCUMENTS

| | | |
|---|---|---|
| 0 527 407 | 2/1993 | European Pat. Off. . |
| 1569961 | 6/1980 | United Kingdom . |
| 2 288 367 | 10/1995 | United Kingdom . |

*Primary Examiner*—J. Reed Fisher
*Attorney, Agent, or Firm*—Kenyon & Kenyon

[57] ABSTRACT

The present invention relates to a method and apparatus for normalizing the zero points for each ink key in an ink fountain. The method and apparatus are useful in an ink fountain using an inker roll and a meter roll which are spaced by a gap, which gap can have possible variations in width. The method is performed when an operator programs the ink fountain controller with a reference point corresponding to the position of the ink key where ink is first transferred from the inker roll to the meter roll - - - the zero points for the ink keys. The reference points for all the ink keys are then normalized within the ink fountain controller, such that an operator display shows a uniform value for the individual reference points for all the ink keys.

19 Claims, 6 Drawing Sheets

METHOD AND APPARATUS FOR NORMALIZING THE DISPLAY OF INK KEY ZERO POINTS IN AN INK FOUNTAIN

BACKGROUND OF THE INVENTION

1. Field of the Invention

The present invention relates to a method and apparatus for normalizing the zero points for each ink key in an ink fountain. The method and apparatus are useful in an ink fountain using an inker roll and a meter roll which are spaced by a gap, which gap can have possible variations in width. The present invention relates to a technique wherein an operator programs the ink fountain controller with a reference point corresponding to the position of the ink key where ink is first transferred from the inker roll to the meter roll - - - the zero transfer points for the ink keys. The reference points for all the ink keys are then normalized within the ink fountain controller, such that an operator display shows a uniform value for the individual reference points for all the ink keys. As a result of this display, operation of the individual ink keys proceeds from this normalized displayed reference point, and uniform opening of the keys across the fountain will be displayed in a uniform manner to the operator. Operation of the ink keys from a reference point displayed as a uniform value ensures uniform, linear distribution of ink for each ink key in the ink fountain, and eases the operator's ability to accurately control the uniform distribution of ink from the fountain.

2. Discussion of the Prior Art

U.S. Pat. No. 4,008,664 to Crum et al. describes a control system for controlling the position of ink keys in an ink fountain. This patent describes a CRT display device coupled to individual ink key adjustment switches. The display device displays a horizontal line of varying height, such that the height of the horizontal line indicates the position of each ink key relative to the fountain roll.

U.S. Pat. No. 4,854,234 to Emery et al. describes generally a row of multiple ink keys in an ink fountain, and the manner in which the keys are adjusted relative to a fountain roll to control the flow of ink from the fountain. This patent describes a particular mechanism used to prevent leakage from the ink fountain when the press is shut down, which mechanism presses the blade of the ink key against the fountain roller - - - i.e., adjusts the blade to the mechanical zero point - - - at press shut-down, without having to mechanically adjust the setting of the ink key.

U.S. Pat. No. 5,138,944 to Rancourt et al. describes an ink fountain control system. The method and apparatus shown in this patent are used to set a uniform lithographic zero position for each of the ink keys in an ink fountain. The method is accomplished by advancing each key until it contacts the fountain roll - - - i.e., is set at its mechanical zero point - - - and then backing the ink key away from the fountain roll a predetermined distance, stored in the controller as the lithographic zero point. In this way, the lithographic zero point is set uniformly throughout the ink fountain.

SUMMARY OF THE INVENTION

The present invention is a method and apparatus which improves the ease of operator control, and the overall uniformity, of ink transfer from an ink fountain using a plurality of ink keys. The present invention is particularly suited for an ink fountain using an inker roll and a meter roll, in which there is a gap between the inker roll and meter roll which may vary along the length of the rolls. Because of the potential variations in this gap, the ink transfer point - - - that position of the ink key that first allows transfer of ink from the inker roll to the meter roll - - - can be different for the various ink keys along the length of the ink fountain. The present invention allows the operator to adjust the ink fountain such that the ink transfer point is recorded in the controller of the ink fountain for each ink key. These transfer points are then normalized on the operator display for the ink fountain. In this way, the press operator can open each of the ink keys in the ink fountain in a uniform manner, such that ink flow is uniform across the ink keys despite variations in the gap size along the fountain.

The method of the present invention is accomplished by storing in the memory of the ink fountain controller each of the ink key positions corresponding to the ink transfer points. Each of these values are then normalized to a single position on the ink fountain controller display. As a result, the increases in ink flow across the ink fountain can be controlled in a linear fashion, and the operator can much more readily observe the relative ink flow rates between various ink keys in the ink fountain.

BRIEF DESCRIPTION OF THE DRAWINGS

The foregoing and other features of the present invention will become apparent to those skilled in the art, upon reading the following description of preferred embodiments of the invention, in view of the accompany drawings, wherein.

DETAILED DESCRIPTION OF THE INVENTION

Figure 1:
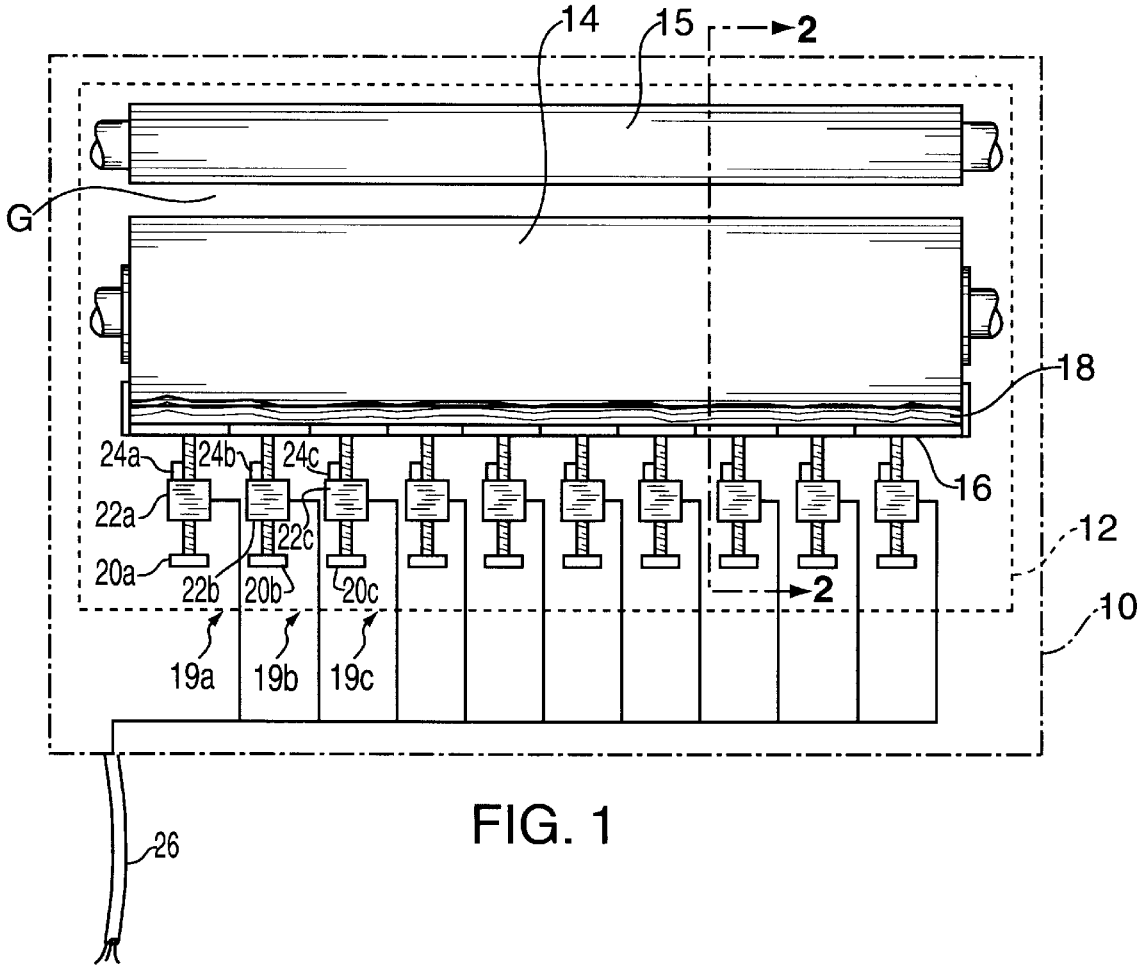
FIG. 1 shows a printing press and an ink fountain of the press, including ink film adjustment keys.

In a preferred embodiment of the invention, a printing press has at least one ink fountain that can be adjusted to control ink film thickness differently at different lateral locations along the fountain. The ink fountain supplies ink for printing images on a web or on sheets of paper. The printing press is represented symbolically by a block 10 in FIG. 1 and includes an ink fountain 12 which has an inker roll 14 extending laterally across the width of the press. In close proximity to the inker roll 14 and extending laterally along it is a flexible doctor blade 16, whether segmented or unitary, whose spacing from the inker roll 14 can be adjusted at various lateral locations along the roll 14 to control locally the amount of ink passing from the ink fountain 12 to printing cylinders or rollers (not shown) of the printing press 10.

Figure 2:
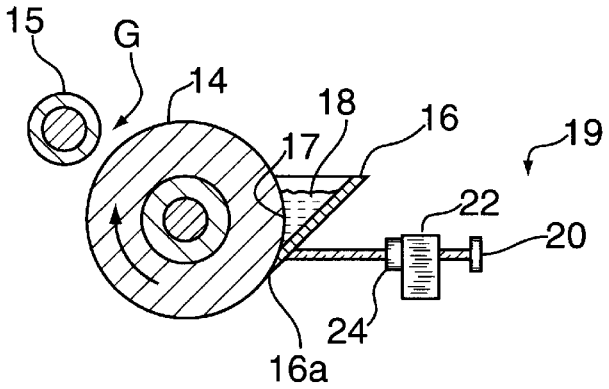
FIG. 2 is an end view of a portion of the ink fountain taken along line 2—2 of FIG. 1.

As shown in FIG. 2, an angular portion 17 of the inker roll 14 forms one main wall of an ink reservoir whose other principal wall is the doctor blade 16, an arrangement which is well-known in the prior printing art. Ink 18 passes from the ink reservoir through a space between the surface of the inker roll 14 and a lower edge 16*a* of the doctor blade 16, to establish a controlled thickness of ink on the inker roll 14. Ink on inker roll 14 is thereafter transferred to a meter roll 15, once the thickness of the ink layer on inker roll 14 is sufficiently large to bridge a gap G between the rolls 14 and 15. The relative size of gap G in FIGS. 1 and 2 is greatly exaggerated for ease of explanation.

A plurality of ink flow adjustment devices 19, which are individually denominated 19*a,* 19*b,* etc. are deployed at various lateral locations along the ink fountain 12 to press against the flexible doctor blade 16 at those locations to establish and adjust the size of the ink film space between the inker roll 14 and the doctor blade 16 in each respective neighborhood. Preferably, each ink flow adjustment device 19 includes an ink key 20, individually designated 20*a,* 20*b,* etc., having screw threads engaging threads in a fixed portion of the frame of the ink fountain, and having a tip which pushes against the doctor blade 16 to deflect it and, thereby, provide locally adjustable control of the blade's spacing from the inker roll 14. Each key may be driven by a small bidirectional actuator motor 22. The motors are individually designated 22*a,* 22*b,* etc., and they move the key 20 in and out axially. Also provided is a position sensor for each of the keys 20, which may include a potentiometer 24, individually designated 24*a,* 24*b,* etc. A movable arm of potentiometers 24*a,* 24*b,* etc. is mechanically connected with the keys 20*a,* 20*b,* etc. so as to assume a position representative of the position of the key 20. Each potentiometer 24 is energized electrically at its outside terminals so that an electrical signal indicative of the position of the key 20 is produced at a potentiometer terminal that is connected to the movable arm.

Each motor 22 is electrically actuatable to drive its respective key 20 in either direction in accordance with electrical commands received on conductors which are part of a cable 26. Cable 26 interconnects the ink fountain 12 with an operating station including switches 36, described in more detail hereinafter. The output signals from the potentiometers 24, which may be multiplexed if desired, are connected to other conductors in the cable 26.

Meter roll 15 transfers ink from inker roll 14 to printing cylinders (not shown) in printing press 10. Inker roll 14 is spaced from meter roll 15 by a gap G, which gap may vary in width along the length of the rolls 14 and 15 depending on mechanical alignment, variations in roll diameter or roll bending. Accordingly, the ink transfer point or ink zero position - - - that position of an individual ink key 20 at which the thickness of the ink layer on inker roll 14 is sufficient to bridge gap G and transfer ink onto meter roll 15 - - - can vary along the length of the ink fountain. As a result, each ink key 20 may need to be individually adjusted to arrive at the ink zero position for that segment of the ink fountain. The method and apparatus of the present invention accomplishes that result, and provides a normalized display for an operator once adjustment has been accomplished.

Figure 3A:
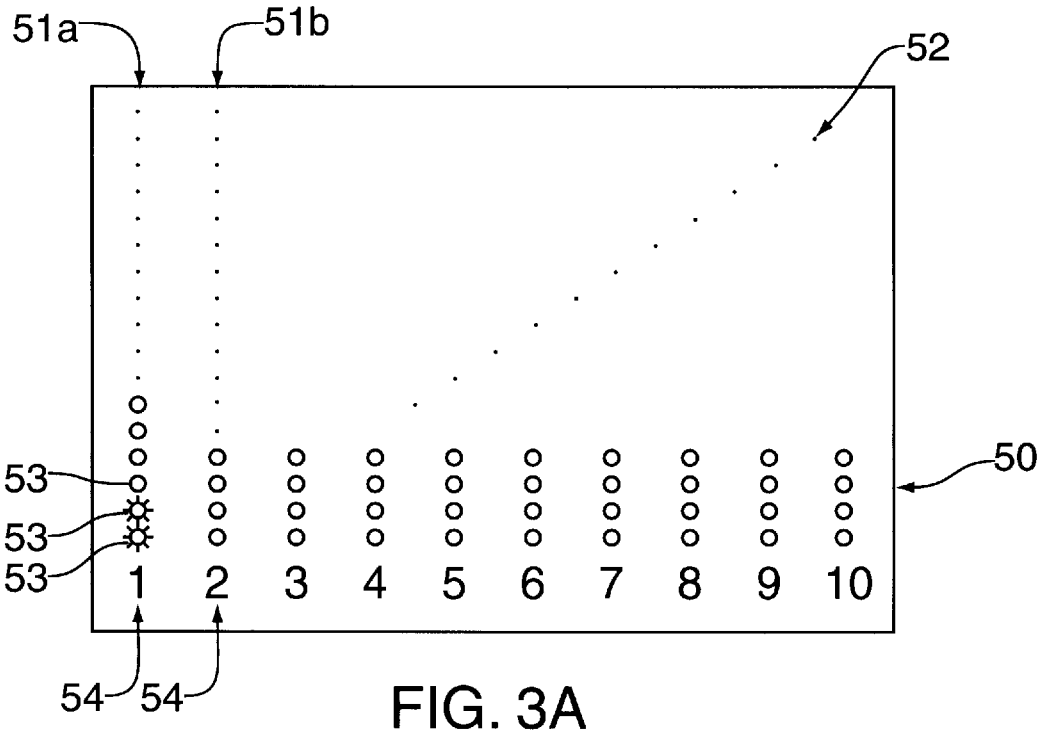
FIGS. 3*a* and 3*b* are front views of two embodiments of a display device of the present invention.
Figure 3B:
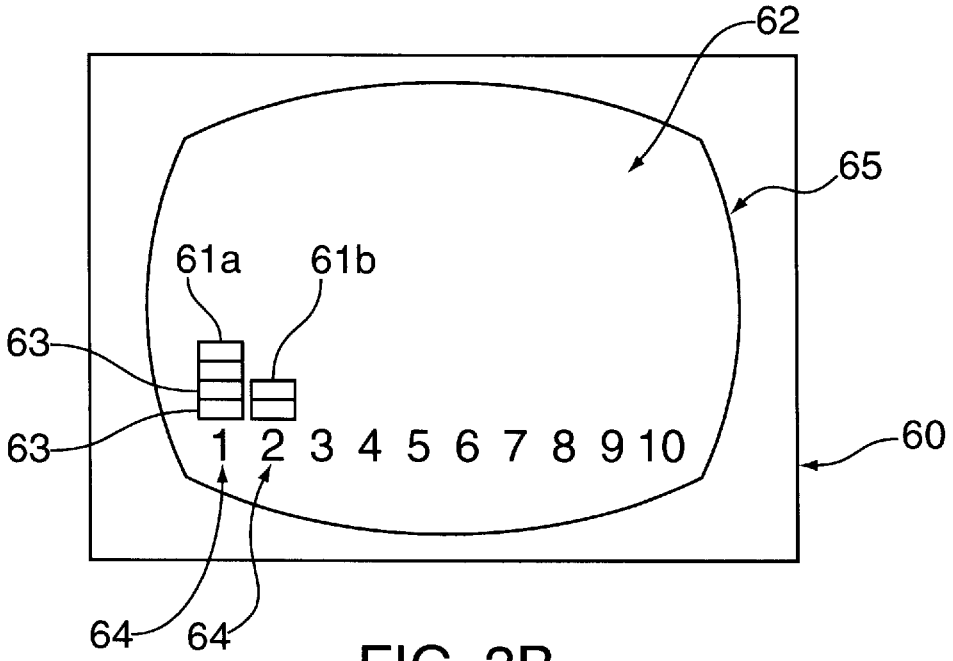

FIGS. 3*a* and 3*b* represent two different embodiments of an operator display device for the present invention. In FIG. 3*a,* the display device 50 consists of columns 51*a,* 51*b,* etc. of light emitting diodes (LEDs) 53, each column of LEDs corresponding to one of the ink keys 20*a,* 20*b,* etc. in an ink fountain 12. Numerals 54 are placed on display device 50 to indicate the particular ink key 20*a,* 20*b,* etc. to which the columns 51*a,* 51*b,* etc. correspond. The columns 51*a,* 51*b,* etc. together form a matrix 52 which visually displays information regarding the position of the ink keys 20*a,* 20*b,* etc. in the ink fountain 12. Alternatively, the LEDs could be arranged in rows, where each row of LEDs corresponds to one of the ink keys 20*a,* 20*b,* etc. in an ink fountain 12. In a preferred embodiment, each row 51 of LEDs 53 consists of fifty LEDs 53, to thereby form (in the case of a 10-key fountain) a 10×50 matrix 52, wherein each LED 53 corresponds to an incremental 2% movement of the ink key 20 along its entire range of movement.

As is discussed more fully below, a ink zero normalization point is displayed on the display device 50 in order to aid the operator in controlling ink flow. This normalization point can be set at an arbitrary value - - - in the preferred embodiment, 5% - - - of the total length of the rows 51 of matrix 52. Thus, the first two LEDs 53 in each row 51 indicate a position of the ink keys 20 which is below the ink zero point for that key. The display device of FIG. 3*a* can indicate the above-described normalization point in several different ways. First, a line above the first two LEDs 53 can be placed on display 50, to thereby indicate that the LEDs 53 below that line display ink key position below the normalized ink zero point, and the LEDs 53 above the line display ink key positions above the normalized ink zero point. The display device of FIG. 3*a* could also be manufactured so that the two LEDs 53 which indicate ink key positions below the normalized ink zero point are of a different color than those LEDs 53 above the normalized ink zero point.

FIG. 3*b* shows an alternative embodiment of the display device of the present invention. In this embodiment, display device 60 consists of a video or cathode ray tube (CRT) screen 65. Screen 65 has displayed thereon rows 61*a,* 61*b,* etc. of colored blocks 63. The colored blocks 63 serve the same function as the LEDs 53 described above with regard to the embodiment of FIG. 3*a,* and together form a matrix 62 which visually displays information regarding the position of the ink keys 20*a,* 20*b,* etc., in the ink fountain 12. Screen 65 also has displayed thereon numerals 64, which indicate the particular ink keys 20*a,* 20*b,* etc. to which the rows 61*a,* 61*b,* etc. correspond. Therefore, in a preferred embodiment, a total of 50 colored blocks 63 may be displayed for each row 61*a,* 61*b,* etc., each colored block 63 corresponding to an incremental 2% movement of the ink key 20 along its entire range of movement.

As with the embodiment of FIG. 3*a,* the embodiment of FIG. 3*b* can also use a visual representation to indicate positions of the ink keys below and above the ink zero value. Thus, the first two blocks 63 in each row 61 indicate a position of the ink keys 20 which is below the ink zero point for that key. The display device of FIG. 3*b* can indicate the above-described normalization point in several different ways. First, a line above the first two blocks 63 can be placed on display 60, to thereby indicate that the blocks 63 below that line display ink key position below the normalized ink zero point, or the background of the display screen below and above the first two blocks 63 could be of different colors or shades. The display device of FIG. 3*b* could also be structured so that the two blocks 63 which indicate ink key positions below the normalized ink zero point are of a different color than those blocks 63 above the normalized ink zero point.

Figure 4:
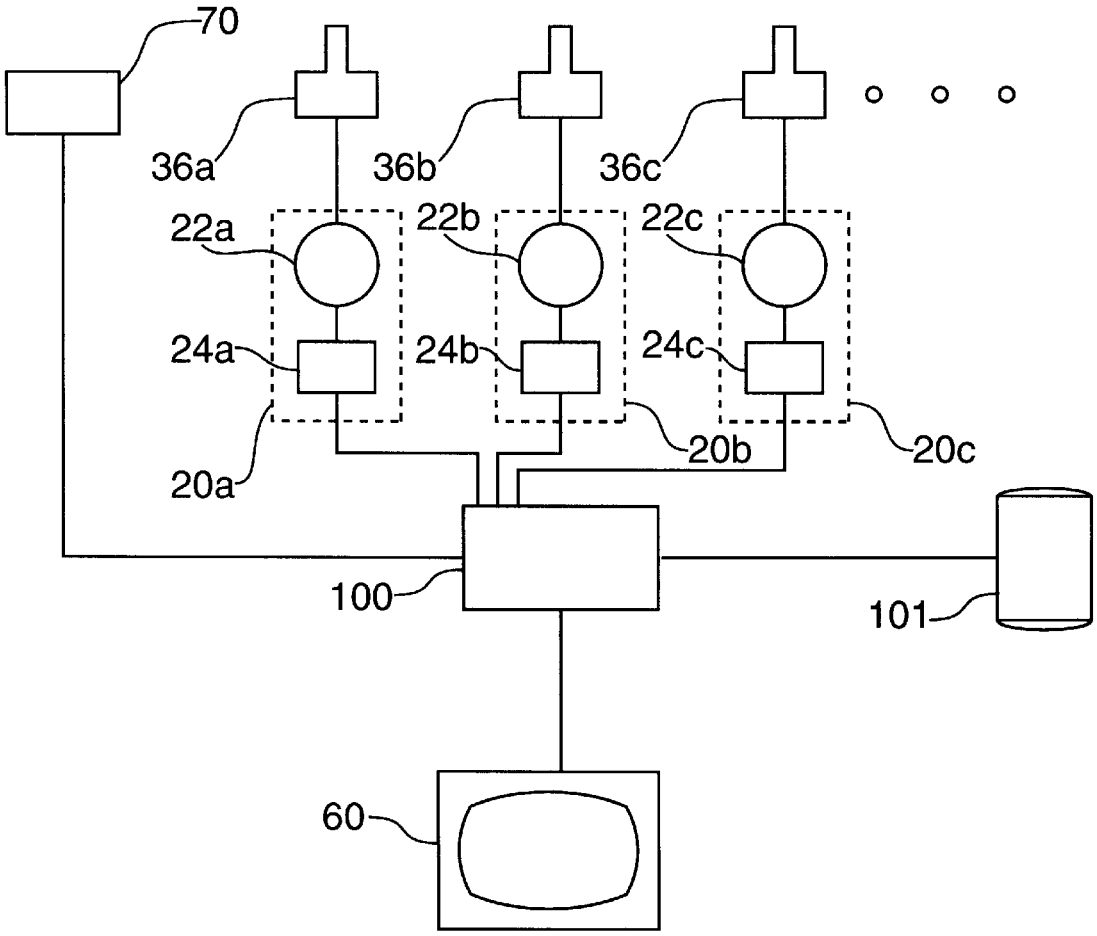
FIG. 4 is a schematic representation of the control system for the present invention.

FIG. 4 is a schematic representation of the control system for the apparatus and method of the present invention. An array of manual control switches 36*a,* 36*b,* etc. is provided on an operator control panel, wherein each switch 36*a,* 36*b,* etc. corresponds to a particular ink key 20*a,* 20*b,* etc. in the ink fountain 12. The switches are operable to three positions: a central neutral position, a near position in which the switch lever in nearer to the operator, and a far position in which the switch lever is farther from the operator. The near and far positions are spring return positions, from which the switch returns to the neutral position when released by the operator. The switches 36*a,* 36*b,* etc. are individually connected to a corresponding motor 22*a,* 22*b,* etc. In the near position of the switches 36*a,* 36*b,* etc., the motors 22*a,* 22*b,* etc. move the respective keys 20*a,* 20*b,* etc. to establish greater space between the doctor blade 16 and the inker roll 14; in the far position, the switches 36*a,* 36*b,* etc. actuate the motors 22*a,* 22*b,* etc. to drive the respective ink adjustment key 20*a,* 20*b,* etc. in a direction to reduce the ink film space in a respective lateral neighborhood of the inker roll 14. The operator control panel also includes an operator input device 70. Operator input device 70, which can be, for example a touch-screen on display 60 or any other equivalent operator input device, is actuated by an operator during the ink key normalization sequence, described in more detail below.

As described above, potentiometers 24*a,* 24*b,* etc. are connected to ink keys 20*a,* 20*b,* etc. to indicate the position of the key 20*a,* 20*b,* etc. as the motors 22*a,* 22*b,* etc. are activated. Signals from potentiometers 24*a,* 24*b,* etc. are fed, via cable 26, to a microprocessor, or similar computational device, 100, which stores and processes information regarding the position of the ink keys 20*a,* 20*b,* etc. in the ink fountain 12. The manner in which these signals are processed is described below. Microprocessor 100 is connected to the display device (shown in FIG. 4 as video display device 60, but which can be an LED display device 50 also), and controls the illumination of LEDs 53 or the display of colored blocks 63 as described below. A storage device 101, such as a hard drive, magnetic tape, optical disk or other equivalent read-write device, is connected to microprocessor 100 to store data processed by the microprocessor 100.

Operation

Figure 5:
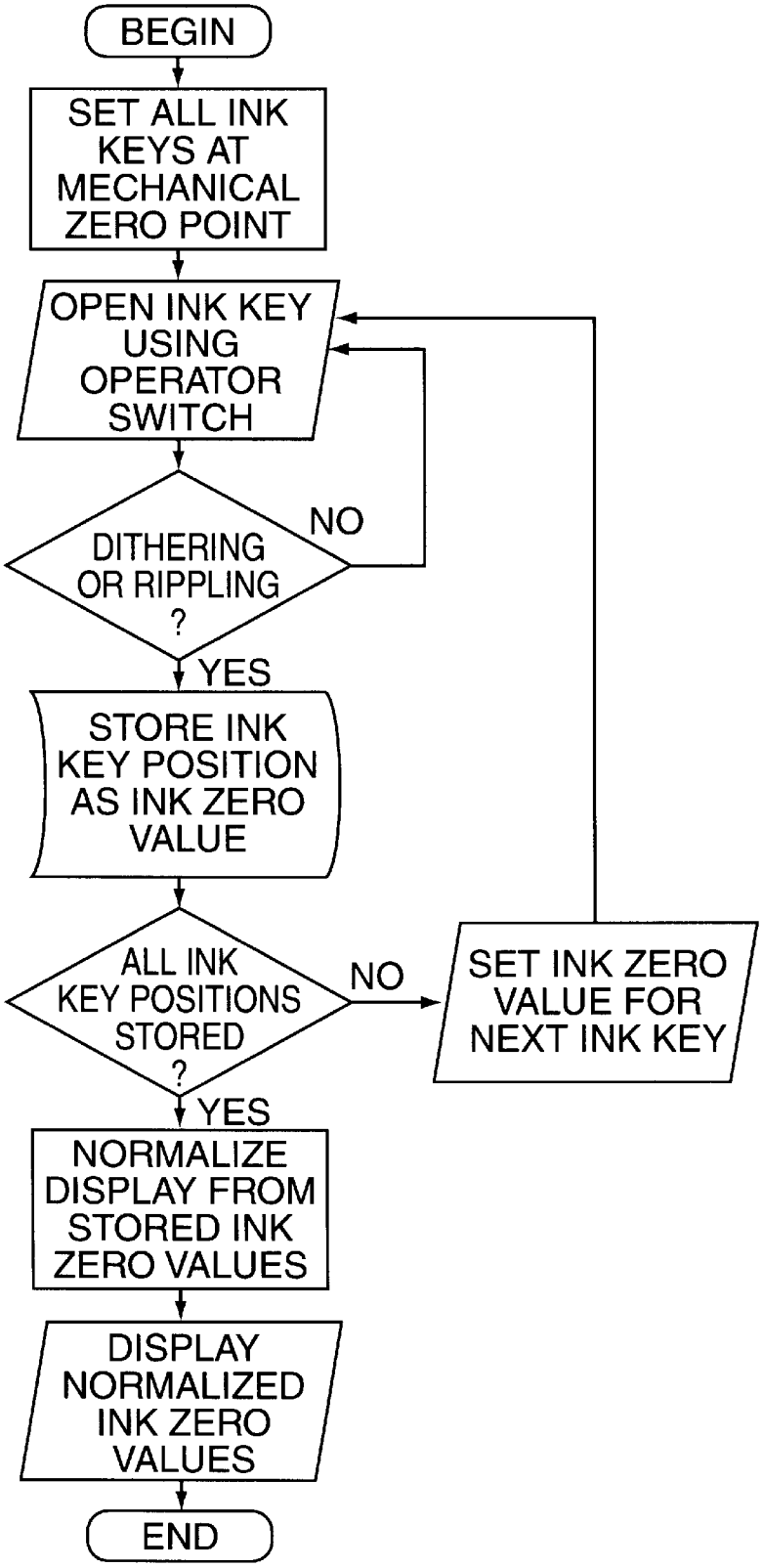
FIG. 5 is a flow chart for the method of normalizing the display of the present invention.

Operation of the device of the present invention is described below, with reference to FIGS. 5–8. FIG. 5 shows a flow chart for the initial operation of setting, storing, normalizing and displaying the ink zero values of the ink fountain 12. First, the ink zero point is determined and stored for each individual fountain. The ink keys 20 are set at their mechanical zero points - - - that point at which the ink fountain is closed, i.e., the lower edge 16*a* of doctor blade 16 rests against inker roll 14. This operation can be accomplished by actuation by an operator of an element on operator input device 70 which is used to initial an ink key normalization routine, and preferably is labeled "SET INK KEY POSITIONS." After all ink keys 20 have been moved to their mechanical zero points, each ink key 20 is then opened by the operator, using switches 36*a,* 36*b,* etc., until dithering or ripple of the ink feeding back on the inker roll 14 is observed by the operator. Such dithering or ripple indicates that the ink on the inker roll 14 has begun splitting to the metering roll 16, and thus ink is being transferred to the metering roll 16 across gap G. Once this dithering or ripple is observed by an operator or detected by an appropriate sensor, either the operator initiates storage of the ink key 20 position by actuating an element on operator input device 70, which is preferably labeled "SET INK KEY TRANSFER POSITION," or in the case of the use of a sensor, the sensor initiates storage of the ink key 20 position. Actuation of this element on operator input device 70 causes the ink key 20 position, which is sensed by potentiometer 24 and stored in a buffer location in microprocessor 100, to be transferred from the buffer location to a storage location in storage device 101. Actuation of the element on operator input device for storing the ink key position also causes the stored program to initiate an identical sequence for determining and storing the ink zero position for a subsequent ink key 20. The above steps are followed until the ink zero positions for each ink key 20 has been determined and stored.

Once the all ink key zero positions for the fountain 12 have been determined and stored, the stored program displays all ink key positions on display device 50 or 60 as a normalized value. This is accomplished by retrieving a stored normalization point - - - e.g. 5% of the length of the display rows 51 or 61 - - - and displaying this point for all the rows 51 or 61 on display device 50 or 60. At the same time, the gain value for each individual ink fountain may be calculated and stored. The gain value for a particular ink key is calculated as the ink zero position for that ink key divided by the uniform normalization point for the entire ink fountain. As will be discussed below, the stored ink zero position, both the gain value and the ink zero position value are used in subsequent sequences for operating the ink keys 20 and displaying the results of ink key operation on the display device 50 or 60.

Figure 7:
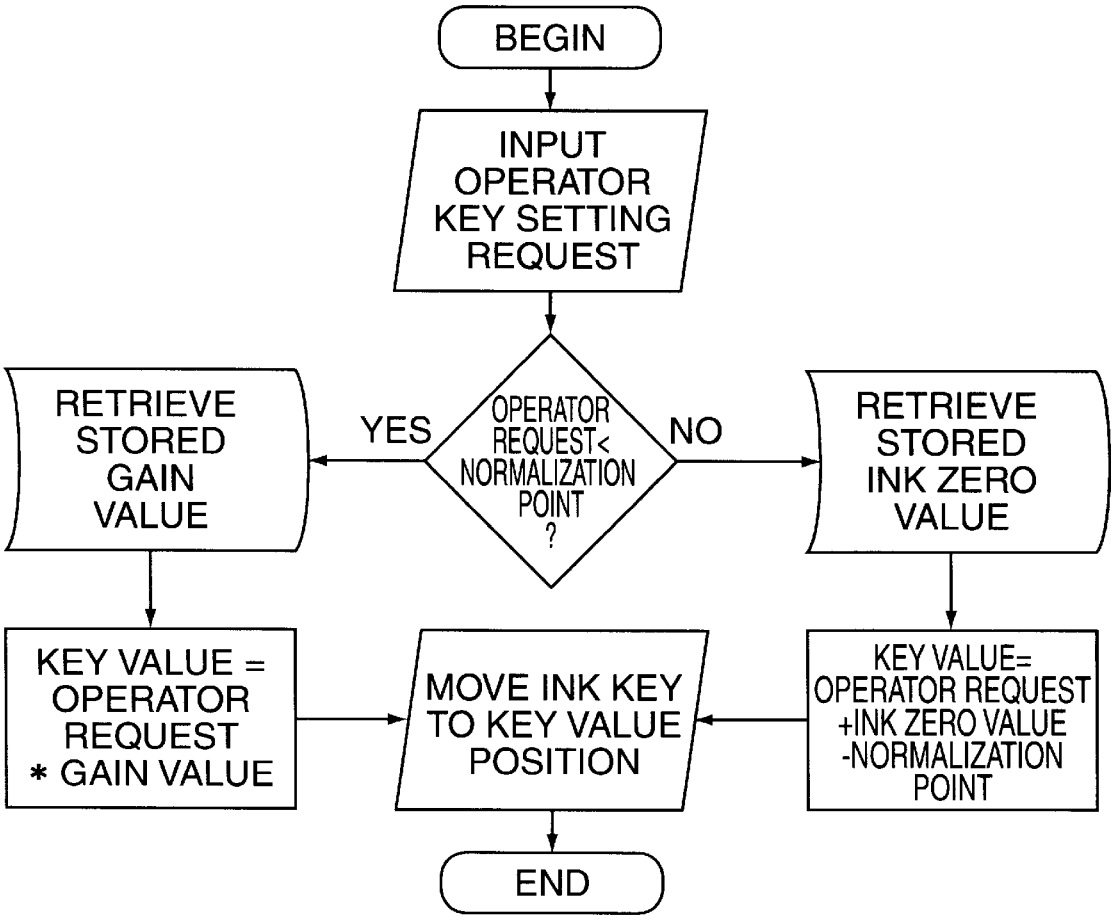
FIG. 7 is a flow chart for the method of advancing ink keys in the ink fountain of the present invention according to an operator request.

FIG. 7 shows a flow chart for a sequence for advancing ink keys 20 in response to commands at the operator control panel. First, an operator at the operator control panel inputs a request for a key position for a particular ink key 20*a,* 20*b,* etc. by operating switches 36*a,* 36*b,* etc. - - - corresponding to the ink key 20 to be operated - - - to their near or far position. If the requested position of the ink key is a value which is below the normalization point stored in microprocessor 100 and storage device 101, the stored gain value is retrieved, and the operator request is multiplied by this gain value. The resulting product is the key value, i.e., the actual percentage of the range of movement of the ink key to which the ink key is moved. If, however, the requested position of the ink key is a value which is greater than or equal to the normalization point, the stored ink zero value is retrieved, and the key value is set at the operator request plus the ink zero value less the normalization point. After the key value is determined, the ink key is moved to the resulting ink key position corresponding to the key value.

Figure 8:
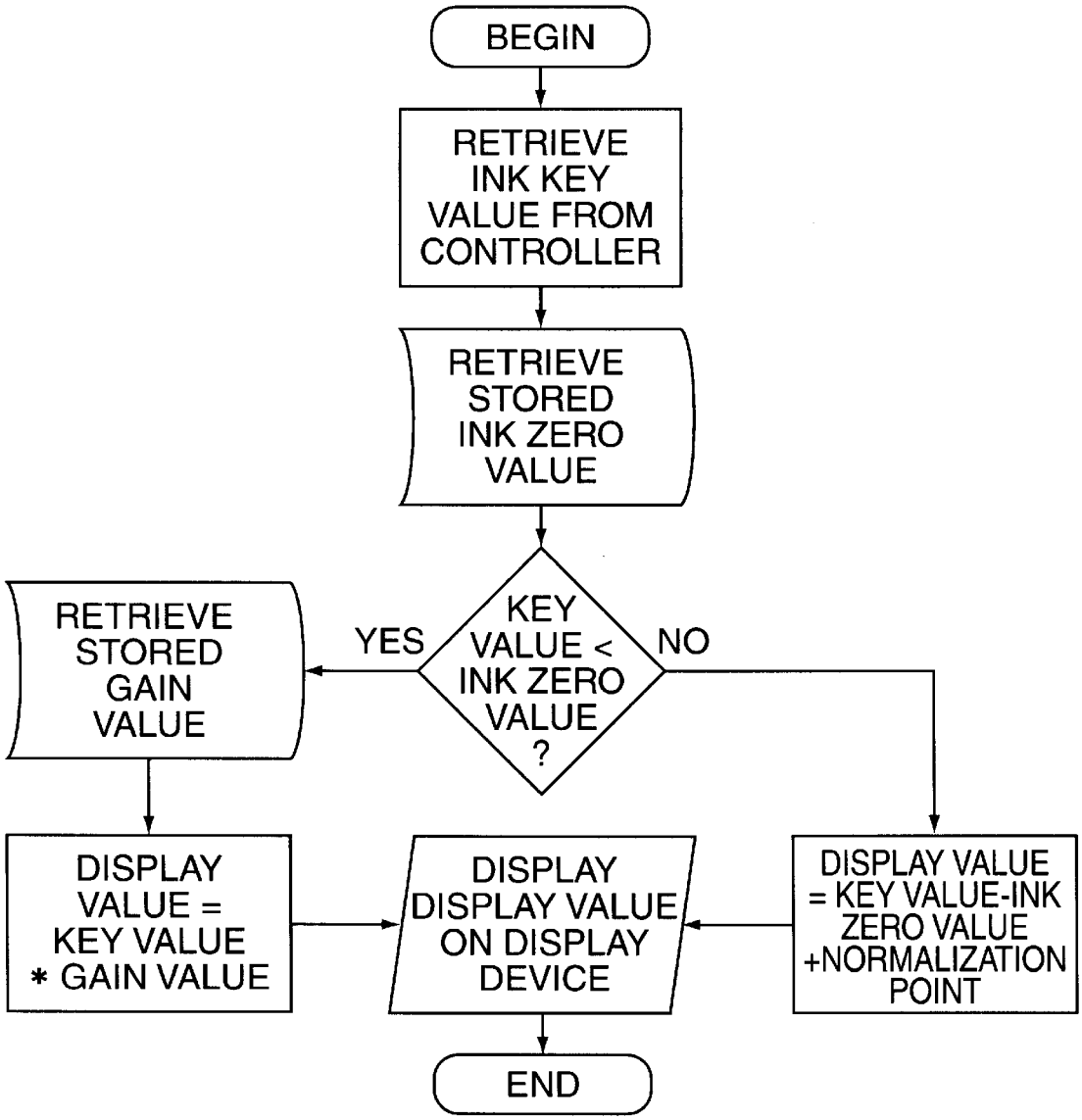
FIG. 8 is a flow chart for the method of displaying ink key position on the display device of the present invention according to actual ink key position.

After the sequence of FIG. 7 is accomplished, the display 50 or 60 is updated with the new key value according to the flow chart of FIG. 8. The key value is retrieve from a buffer in microprocessor 100 controller. In addition, the stored ink zero value is retrieved from storage device 101. If the key value is less than the ink zero value, the gain value is also retrieved from the storage device 101. The microprocessor 100 controller then calculates the display value, i.e., that percentage of the length of rows 51 or 61 which will be displayed. The display value, if the key value is less than the ink zero value, is calculated as the key value multiplied by the gain value. If the key value is greater than or equal to the ink zero value, the display value is the key value less the ink zero value plus the normalization point. After the display value has been calculated, this value is sent to the display device 50 or 60, and the appropriate number of LEDs 53 are illuminated or blocks 63 displayed, according to the position of the ink keys 20 chosen by the operator.

Figure 6:
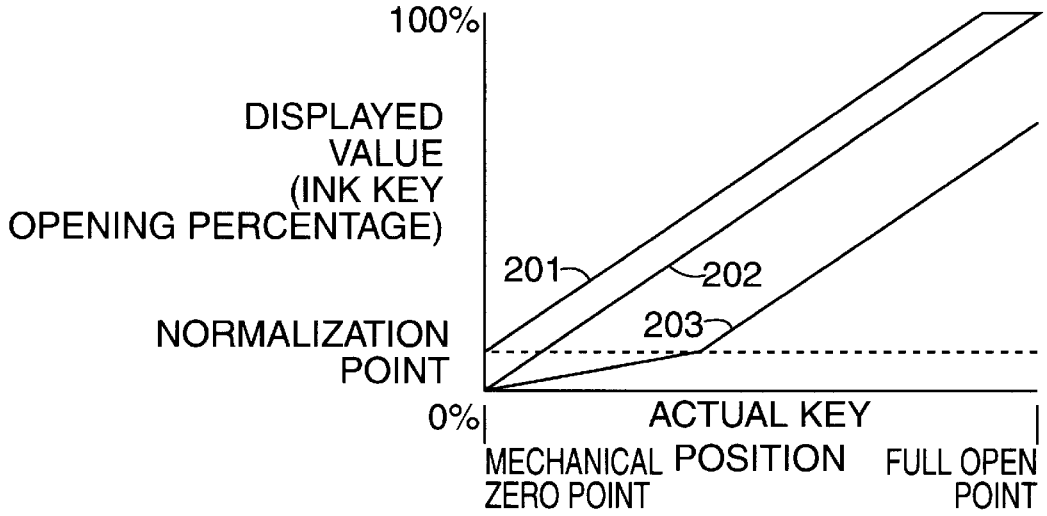
FIG. 6 is a graph showing the manner in which ink flow is linearized for different ink key locations in the method and apparatus of the present invention.

FIG. 6 is a graph which shows the manner in which displayed ink key position will reflect actual ink key position, in a linear fashion, above the set normalization point, and below the normalization point, the displayed ink key positions are adjusted according to the actual ink zero point. In FIG. 6, the x-axis represents the actual key value of an ink key 20 in the ink fountain 12, with the origin being the mechanical zero point. The y-axis in FIG. 6 is the percentage of the row 51 or 61 which is displayed for a particular ink fountain in the display device 50 or 60, with the origin being the condition where no LED 53 is illuminated or no block 63 is displayed. Curve 201 represents an ink key 20 in which the mechanical zero point and the ink zero point are essentially identical - - - i.e., the gap G width is very small. Curve 202 represents an ink key 20 in which the ink zero point is in an expected position - - - i.e., the gap G is of an expected width. Curve 203 represents an ink key 20 in which the ink zero point is farther than expected along the range of movement of the ink key - - - i.e., the gap G width is larger than expected. As shown in FIG. 6, above the normalization point, the displayed ink key value exhibits a linear relationship of consistent slope for all of the curves 201, 202 and 203. In this way, identical changes in the key value - - - the actual position of the ink key in the fountain - - - will be displayed in an identical manner across the ink keys, no matter what the ink zero point is. Below the normalization point, the display value is linearized such that the display is linearized between the mechanical zero point and the ink zero point.

While the forgoing represents a description of several preferred embodiments of the method and apparatus of the present invention, it is to be understood that the claims below recite the features of the present invention, and that other embodiments, not specifically described hereinabove, fall within the scope of the present invention.

We claim:

1. An ink fountain for controlling a flow of ink to printing rollers in a printing press, said ink fountain comprising:

an inker roll;

a plurality of ink keys, said ink keys being individually movable relative to said inker roll to thereby create a gap between said ink key and said inker roll, said ink keys controlling said flow of ink once said ink keys are moved past an ink zero value;

a display device; and an ink fountain controller, said ink fountain controller controlling the size of said gap, said fountain controller further controlling a display at said display device, said ink fountain controller normalizing said display for each said ink zero value for each said ink key.

2. The ink fountain of claim 1, further comprising:

a meter roll adjacent said inker roll.

3. The ink fountain of claim 2, wherein:

said meter roll is separated from said inker roll by a gap, said ink zero value for each said ink key corresponding to a position of said ink key at which ink on said inker roll transfers to said meter roll.

4. The ink fountain of claim 1, further comprising:

a storage device.

5. The ink fountain of claim 1, wherein:

said display device comprises a matrix of light-emitting diodes.

6. A method of operating an ink fountain comprising an inker roll, a plurality of ink keys and a display device, said method comprising the steps of:

determining an ink zero value for each said ink key; and providing a normalized display at said display device representative of a position of each said ink key in said fountain, said step of providing a normalized display comprising normalizing said display for each said ink zero value for each said ink key.

7. The method of claim 6, further comprising the step of:

setting each of said ink keys at a mechanical zero point before said step of determining an ink zero value.

8. The method of claim 6, wherein:

said step of determining an ink zero value comprises detecting ink transfer from said inker roll to a meter roll.

9. The method of claim 8, wherein:

said step of determining an ink zero value comprises storing an ink key position of said ink key, after detecting ink transfer, as said ink zero value.

10. The method of claim 6, wherein:

said normalizing comprises displaying a uniform stored normalization value for each said ink zero value for each said ink key.

11. The method of claim 10, further comprising the steps of:

inputting an ink key request for one of said ink keys; and calculating a key value for said ink key dependent upon a relationship between said ink key request and said normalization value.

12. The method of claim 11, wherein:

said step of calculating a key value comprises the step of determining whether said ink key request is less than said normalization value.

13. The method of claim 12, wherein:

said step of calculating a key value further comprises the steps of:

retrieving a stored gain value and multiplying said gain value by said ink key request if said ink key request is less than said normalization value; and adding said ink zero value to, and subtracting said normalization value from, said ink key request, if said ink key request is not less than said normalization value.

14. The method of claim 11, further comprising the step of:

calculating a display value dependent upon a relationship between said key value and said ink zero value.

15. The method of claim 14, wherein:

said step of calculating a display value comprises the step of determining whether said key value is less than said ink zero value.

16. The method of claim 15, wherein:

said step of calculating a display value further comprises the steps of:

retrieving a stored gain value and multiplying said gain value by said key value if said key value is less than said ink zero value; and subtracting said ink zero value from, and adding said normalization value to, said key value if said key value is not less than said ink zero value.

17. The ink fountain of claim 5, wherein:

said display device comprises a normalization position, said light-emitting diodes below said normalization position being of a first color and said light-emitting diodes above said normalization position being of a second color different from said first color.

18. The ink fountain of claim 1, wherein:

said display device comprises a video display unit displaying a matrix of blocks.

19. The ink fountain of claim 18, wherein:

said display device comprises a normalization position, said blocks below said normalization position being of a first color and said blocks above said normalization position being of a second color different from said first color.

* * * * *